US008226374B2

(12) United States Patent
Peterson et al.

(10) Patent No.: US 8,226,374 B2
(45) Date of Patent: Jul. 24, 2012

(54) VARIABLE MOTOR DRIVE SYSTEM FOR A RESERVOIR WITH CIRCULATING FLUID

(75) Inventors: Gregory A. Peterson, South Barrington, IL (US); Michael P. Sullivan, Algonquin, IL (US); Donald E. Morgan, Florissant, MO (US); Bret S. Clark, Oakville, MO (US)

(73) Assignee: Nidec Motor Corporation, St. Louis, MO (US)

( * ) Notice: Subject to any disclaimer, the term of this patent is extended or adjusted under 35 U.S.C. 154(b) by 457 days.

(21) Appl. No.: 12/503,435

(22) Filed: Jul. 15, 2009

(65) Prior Publication Data

US 2010/0017954 A1 Jan. 28, 2010

Related U.S. Application Data

(60) Provisional application No. 61/083,410, filed on Jul. 24, 2008.

(51) Int. Cl.
*F04B 49/00* (2006.01)

(52) U.S. Cl. ..... 417/46; 318/599

(58) Field of Classification Search ..... 318/599, 318/811, 432, 799; 417/45, 46
See application file for complete search history.

(56) References Cited

U.S. PATENT DOCUMENTS 4,233,694 A 11/1980 Janosko et al.
D295,785 S 5/1988 Gordon
5,151,017 A * 9/1992 Sears et al. ..... 417/45
5,267,359 A 12/1993 Clark
D348,936 S 7/1994 Swick et al.
5,361,215 A 11/1994 Tompkins et al.
5,418,984 A 5/1995 Livingston, Jr.
D363,060 S 10/1995 Hunger et al.
D370,534 S 6/1996 Hunger et al.
5,548,854 A 8/1996 Bloemer et al.
5,550,753 A 8/1996 Tompkins et al.
5,559,720 A 9/1996 Tompkins et al.
5,585,025 A 12/1996 Idland
5,983,416 A 11/1999 Idland
6,182,303 B1 2/2001 Gardenier et al.
6,253,121 B1 6/2001 Cline et al.
6,253,227 B1 6/2001 Tompkins et al.
6,282,370 B1 8/2001 Cline et al.
6,407,469 B1 6/2002 Cline et al.
6,414,455 B1 * 7/2002 Watson ..... 318/432
(Continued)

OTHER PUBLICATIONS

Rob Stiles, The Need for Speed, Pool & Spa News, Apr. 9, 2007, pp. 50 and 52.

*Primary Examiner* — Walter Benson
*Assistant Examiner* — Antony M Paul
(74) *Attorney, Agent, or Firm* — Maginot, Moore & Beck, LLP

(57) ABSTRACT

A motor drive for an electric motor of a variable fluid circulating system includes a processing module and a power module. The processing module receives a signal profile and generates a control signal based on the signal profile. A power module generates a carrier signal based on the control signal and a direct current (DC) voltage. The power module pulse width modulates the carrier signal to generate a drive signal in the electric motor that matches the signal profile. The power module powers the electric motor based on the drive signal to adjust injection of a fluid into a reservoir.

29 Claims, 6 Drawing Sheets

U.S. PATENT DOCUMENTS

| | | | | |
|---|---|---|---|---|
| 6,516,070 | B2 | 2/2003 | Macey | |
| 6,590,188 | B2 | 7/2003 | Cline et al. | |
| 6,643,108 | B2 | 11/2003 | Cline et al. | |
| 6,643,859 | B1 | 11/2003 | Brennan et al. | |
| 6,662,384 | B1 | 12/2003 | Gardenier et al. | |
| 6,681,414 | B1 | 1/2004 | May et al. | |
| 6,747,367 | B2 | 6/2004 | Cline et al. | |
| D492,936 | S | 7/2004 | Larsen | |
| 6,760,932 | B1 | 7/2004 | Maiuccoro | |
| 6,782,309 | B2 | 8/2004 | Laflamme et al. | |
| 6,965,815 | B1 | 11/2005 | Tompkins et al. | |
| 6,976,052 | B2 | 12/2005 | Tompkins et al. | |
| 7,030,343 | B2 | 4/2006 | Tran | |
| 7,064,517 | B2 * | 6/2006 | Kiuchi et al. | 318/802 |
| 7,076,814 | B2 | 7/2006 | Ostrowski et al. | |
| D534,871 | S | 1/2007 | Larsen | |
| 2004/0025244 | A1 | 2/2004 | Loyd et al. | |
| 2005/0160771 | A1 * | 7/2005 | Hosoito et al. | 68/12.16 |
| 2006/0045750 | A1 | 3/2006 | Stiles | |
| 2007/0114162 | A1 | 5/2007 | Stiles et al. | |
| 2007/0154319 | A1 | 7/2007 | Stiles, Jr. et al. | |

* cited by examiner

VARIABLE MOTOR DRIVE SYSTEM FOR A RESERVOIR WITH CIRCULATING FLUID

FIELD

The present disclosure relates to open fluid reservoirs and more particularly to the control of fluid flow to a reservoir.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Tubs, spas, and pools typically include fluid flow inlet ports that jet water and/or air into an open reservoir. To adjust the flow of water out of the inlet ports, various configurations have been introduced. One configuration includes a pump, a first pipe, a second pipe, and a tub. The first and second pipes include multiple inlet and outlet ports. Flow to the tub is adjusted by moving the first and second pipes to adjust the number of inlet and outlet ports. Although this configuration may be used to adjust the injected pressure of fluid and/or the location at which fluid is injected in the reservoir, this configuration is limited in its ability to dynamically adjust fluid flow.

Other configurations include a variable speed motor and pump that are used to adjust the volume and/or pressure of fluid entering a reservoir. By varying the speed of the motor and pump, the pressure of fluid pulses out of an inlet port is adjusted. Yet other configurations adjust the flow of air injected into a fluid stream, which is then injected into a reservoir. This type of configuration may be used to adjust the rate that fluid enters a reservoir. Still other configurations adjust the frequency and duration of fluid pulses out of an inlet port by adjusting intervals at which an electric motor is switched ON and OFF. The above-described configurations are limited in their ability to dynamically adjust fluid flow.

SUMMARY

In one embodiment, a motor drive for an electric motor of a variable fluid circulating system is provided. The motor drive includes a processing module and a power module. The processing module receives a signal profile and generates a control signal based on the signal profile. The power module generates a carrier signal based on the control signal and a direct current (DC) voltage. The power module pulse width modulates the carrier signal to generate a drive signal in the electric motor that matches the signal profile. The power module powers the electric motor based on the drive signal to adjust injection of a fluid into a reservoir.

In other features, a variable fluid circulating system for at least one of a spa, a tub, and a pool is provided. The variable fluid circulating system includes a user interface that generates a first control signal and a motor drive. The motor drive includes a processing module and a power module. The processing module includes a microprocessor that generates a second control signal based the first control signal. The power module generates a carrier signal based on the second control signal and a DC voltage. The power module pulse width modulates the carrier signal to generate a drive signal with a first signal profile. An electric motor is powered by the pulse width modulated carrier signal and generates the drive signal based on the pulse width modulated carrier signal. A pump receives the drive signal via a mechanical coupling that is connected to the electric motor.

In still other features, the systems and methods described above are implemented by a computer program executed by one or more processors. The computer program can reside on a computer readable medium such as but not limited to memory, nonvolatile data storage, and/or other suitable tangible storage mediums.

Further areas of applicability of the present disclosure will become apparent from the detailed description, the claims and the drawings. It should be understood that the detailed description and specific examples are intended for purposes of illustration only and are not intended to limit the scope of the disclosure.

BRIEF DESCRIPTION OF DRAWINGS

The present disclosure will become more fully understood from the detailed description and the accompanying drawings, wherein.

DESCRIPTION

Figure 1:
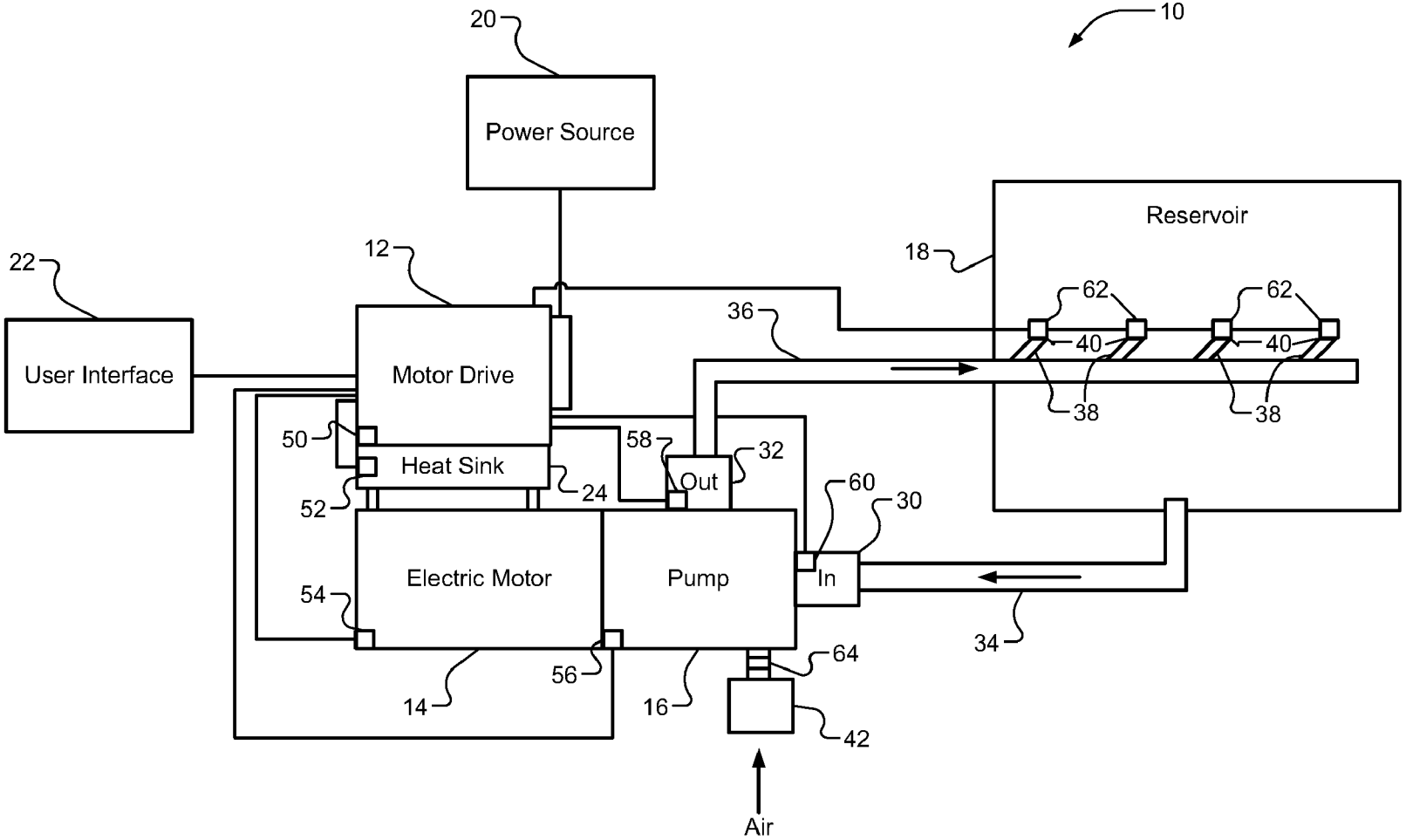
FIG. 1 is a functional block diagram of a variable fluid circulating system according to an embodiment of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include (i) an Application Specific Integrated Circuit (ASIC), (ii) an electronic circuit, (iii) a processor (shared, dedicated, or group) and/or memory (shared, dedicated, or group) that execute one or more software or firmware programs, (iv) a combinational logic circuit, and/or (v) other suitable components that provide the described functionality.

In the following description the terms features or water features may refer to changes in fluid flow and/or pressure at inlets or jets of a reservoir. The features may be provided by speeds of an electric motor and pump using different patterns or signal profiles.

Referring now to FIG. 1, a functional block diagram of a variable fluid circulating system 10 is shown. The variable fluid circulating system 10 includes a motor drive 12, an electric motor 14, a fluid pump 16 and a reservoir 18. The motor drive 12 controls the electric motor 14, which in turn adjusts operation of the pump 16 resulting in dynamic fluid flow control to the reservoir 18. The fluid flow control includes controlled variability in fluid pressure, flow volumes, and flow rates. This fluid flow control provides different therapeutic and relaxing actions provided by the fluid that is injected into the reservoir 18.

The motor drive 12 adjusts the current and/or voltage signal profiles provided to the electric motor 14. This adjustment may include amplitude, frequency, and/or phase modulation of one or more signals and/or of one or more carrier signals. The motor drive 12 may receive power from a power source 20 and a control signal from a user interface 22. In one embodiment, the power source 20 provides a 0-300 direct current (DC) voltage. In another embodiment, the power source 20 provides an alternating current (AC) voltage, which is converted to a DC voltage by the motor drive 12.

The motor drive 12 provides power to the electric motor based on the control signal. The motor drive 12 may be configured to adjust and vary the DC voltage generated and/or used to generate a power signal that is outputted to the electric motor 14. The motor drive 12 may include a heat sink 24 for the dissipation of heat. Example motor drives are shown and described with respect to the embodiments of FIGS. 2 and 3.

The electric motor 14 may be an induction variable speed motor and is electrically connected to the motor drive 12. The electric motor 14 is mechanically connected to the pump 16. The electric motor 14 may be connected to the pump 16 using techniques known in the art, which may include mechanical couplings, such as, but not limited to, shafts, belts, pulleys, etc. The electric motor 14 may have multiple operating modes. A few example, but not exclusive, operating modes include a variable speed mode, a sine flow mode, a pulse flow mode, a triangle flow mode, and a custom profile flow mode. Numerous other modes may be implemented due to the ability to create and download different signal profiles, as described in detail below.

The variable speed mode may allow the pump 16 to be set and held at a single speed or varied between different speeds, which may be set by a user or determined based on a selected signal profile. The user may change the speed at any time during a cycle. The speed of the pump 16 may be set to a speed between 0 and a maximum speed, such as 3600 revolutions per minute (RPM). Due to the operational characteristics of a three phase induction motor, pump motor speeds may be approximately 3 to 5 percent slower than a commanded speed. This is known as slip for an asynchronous induction motor. But the motor drive 12 may be adapted to correct for such differences between actual speed and commanded speed, whereby the motor drive may drive the pump 16 at the commanded speed.

The motor drive 12 may step the electric motor 14 when changing speed. The steps between motor speed settings may be limited to a predetermined level and/or for a predetermined speed operating range, such as approximately 200 RPM at speeds between 1800-3600 RPM. Others step sizes and speed limits may be set, either within the motor drive as part of predetermined settings or selectively by a user via the user interface 22.

The sine flow mode may vary the pump speed and thus the flow of fluid, such as water, in a sine wave profile. The frequency or cycle time of the sine wave is adjustable. In one embodiment, the sine wave is adjusted between 1-10 Hz. Other sine wave frequency ranges may be set. Open loop minimum and maximum speeds of the pump 16 may be adjusted, for example, between 0-3600 RPM. The frequency ranges and minimum and maximum speeds may be adjusted independently of one another, such as by the user via the user interface 22.

The pulse flow mode may vary water pressure in a step type function between two or more operating speeds. The period or cycle time of the pulse flow pattern is adjustable. The cycle time may vary between 1-60 seconds in length. Other lengths of time may be implemented. Minimum and maximum speeds of the pump are adjustable. For example only, the minimum and maximum speeds may be between 0-3600 RPM. The cycle time and minimum and maximum speeds may be adjusted independently of one another, such as by the user via the user interface 22.

The triangle flow mode may maintain a speed profile of the pump 16 according to a triangle wave. The operating ranges are similar to the above described modes. The custom profile flow mode may include the creation of a custom speed and/or flow profile. The ranges may be adjusted independently of one another, such as by the user via the user interface 22.

The pump 16 includes at least one inlet 30 and at least one outlet 32. The inlet 30 is connected to a main reservoir output line 34, which may have one or more secondary input lines (not shown), in fluid communication with the reservoir 18. The outlet 32 is connected to a main reservoir input line 36. The main reservoir input line 36 may be connected to multiple secondary input lines 38, which in turn are connected to inlet ports 40 on the reservoir 18. Fluid circulates in and out of the reservoir 18 through action of the pump 16. The fluid is injected into the reservoir 18 through the inlet ports 40. The reservoir 18 may be of any type, such as, but not limited to, a spa, a tub, a pool, a fountain, etc. The reservoir 18 may be open to allow for entry by a user.

The electric motor 12 and the pump 16 are used to control and vary the flow of fluid and air into the reservoir 18. As fluid flow changes, air flow may automatically change. An air input 42 may be provided on the pump 16 and have a fixed or variable sized opening (not shown). As fluid flow changes, air flow may automatically increase, decrease, or remain constant depending upon the pump configuration. The size of the opening may be controlled by the motor drive 12.

The electric motor 14 and the pump 16 may provide feedback signals to the motor drive 12 that include information, such as, but not limited to, motor speed, heat sink temperature, electric motor temperature, pump temperature, bus voltage, electric motor ON/OFF state, stator voltage, electric motor current, electric motor power, electric motor faults, pump faults, etc. This information may be provided dependant upon the application and corresponding system requirements.

The variable fluid circulating system 10 may also include the user interface 22. A user may control various features of the variable fluid circulating system 10 via the user interface 22. As an example, the user may adjust the profile of the signals provided to the electric motor 14. The user may independently adjust the frequency, amplitude, offset, period, phase, and shape of the signals provided to and/or generated by the electric motor 14. An example change in signal profile is shown in FIG. 5. The user may switch for example between sine, square, triangle, and stepped waveforms, as well as other waveform profiles or create a custom waveform profile. An adjustment in waveform profiles alters the fluid features or the therapeutic and relaxing actions provided. An example of a user interface is shown and described with respect to the embodiment of FIG. 4.

Returning to FIG. 1, the variable fluid circulating system 10 may also include various sensors including a motor drive sensor 50, a heat sink sensor 52, an electric motor sensor 54, a pump sensor 56, a pump out sensor 58, a pump in sensor 60, inlet port sensors 62, as well as other sensors, such as an air input sensor 64. The sensors may detect temperatures of the motor drive 12, the electric motor 14, the pump 16, the reservoir 18, the heat sink 24, the inlet 30, and the outlet 32. The sensors may be used to detect inputs, currents, voltages, power, speed, and/or output of the electric motor 14. The sensors may detect fluid flow rates, fluid volumes, and rates of change in fluid flow, in and out of the pump 16. The sensors may also detect DC bus voltage provided by the power source 20 and/or on a bus within the motor drive 12. The motor drive 12 may operate and/or adjust operation of the electric motor 14 based on information received from the sensors.

Figure 2:
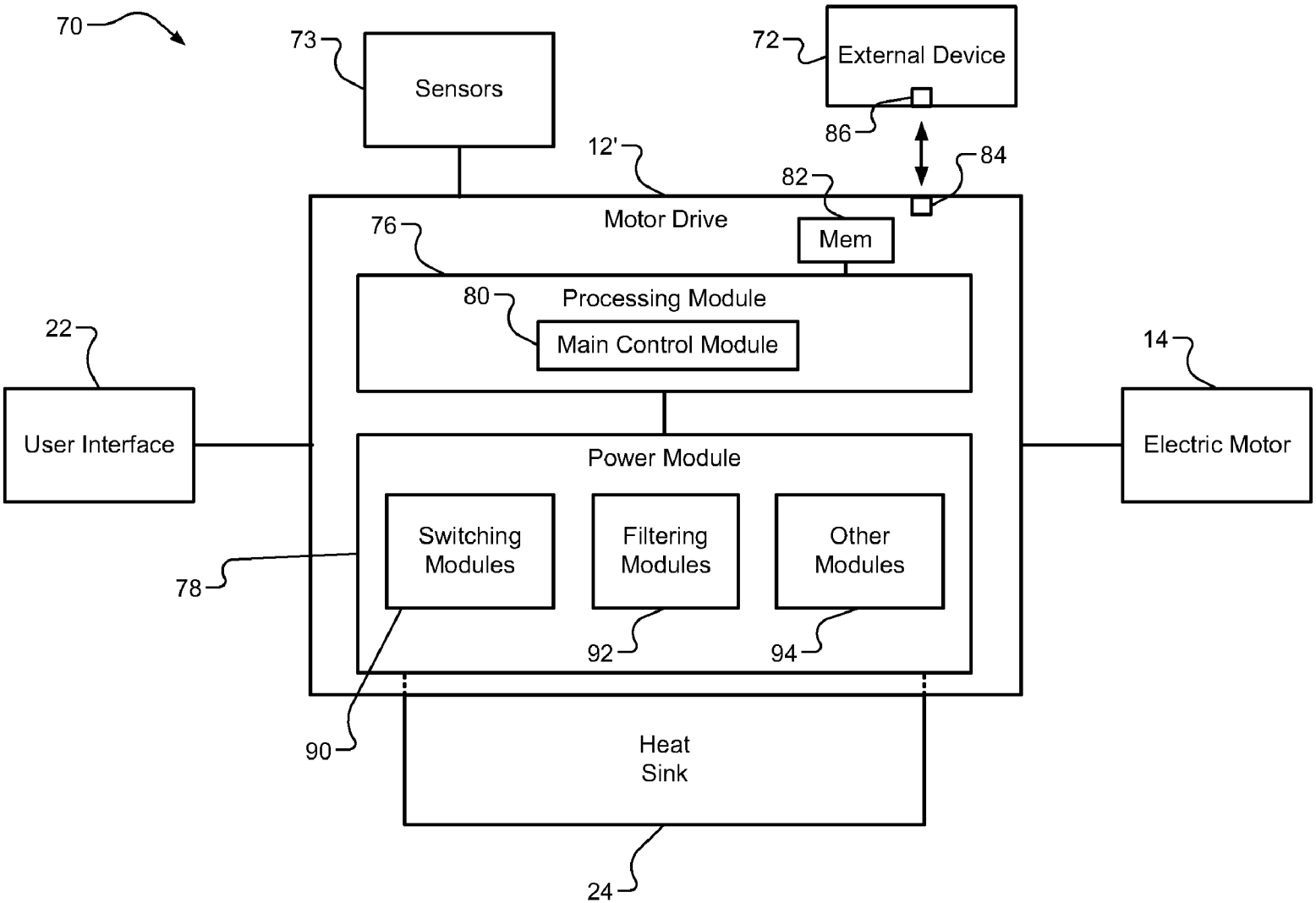
FIG. 2 is a functional block diagram of a variable motor drive system according to an embodiment of the present disclosure.

Referring now to FIG. 2, a functional block diagram of a variable motor drive system 70 is shown. The variable motor drive system 70 includes a motor drive 12', which is in communication with the user interface 22 and an external device 72 and is connected to the electric motor 14. The motor drive 12' adjusts signal profiles provided to the electric motor 14 based on a first control signal from the user interface 22, a second control signal or signal profile received from the external device 72, and/or signals received from sensors 73. The sensors 73 may include sensors 50-62 of FIG. 1.

The motor drive 12' includes a processing module 76 and a power module 78. The processing module 76 is in communication with the user interface 22 and the external device 72. The processing module 76 includes a main control module 80 and is in communication with memory 82. The main control module 80 may be programmed to generate different signal profiles, which may be stored in the memory 82. The signal profiles may be provided to or used to control operation of the power module 78 and to control operation of the electric motor 14.

The memory 82 may be separate from the processing module 76, part of the processing module, part of the power module 78, or external to the motor drive 12'. The memory 82 may include volatile and/or nonvolatile memory. The memory 82 may be used to store signal profiles, which may be selected by the user interface 22, the external device 72, or by the processing module 76 based on internal control logic.

The motor drive 12' may communicate with the user interface 22 and the external device 72 via a wired or wireless link. The motor drive 12', the user interface 22, and the external device 72 may each include a transceiver for the transmission and reception of signals. As an example, the link between the user interface 22 and the motor drive 12' is shown as a wired link and the link between the external device 72 and the motor drive 12' is shown as a wireless link. The external device 72 has a first transceiver 84 and the motor drive 12' has a second transceiver 86. The wireless signals may be transmitted according to any standard, such as, but not limited to, IEEE standards 802.11, 802.11a, 802.11b, 802.11g, 802.11h, 802.11n, 802.16, and 802.20, for example. The motor drive 12', the user interface 22, and the external device 72 may be Bluetooth compatible, or with any other wireless protocol. Other wireless communication transmission means may also or alternatively be used, including infrared transmission, radio transmission, etc.

For example only, the user interface 22 and the external device 72 may transmit control signals for the adjustment of a signal profile and/or for the selection of a signal profile. The user interface 22 may receive status signals from the processing module 76 indicating, for example the selected signal profile, a motor speed, a selected motor ON time, etc. The external device 72 may also download signal profiles to the motor drive 12'.

Figure 4:
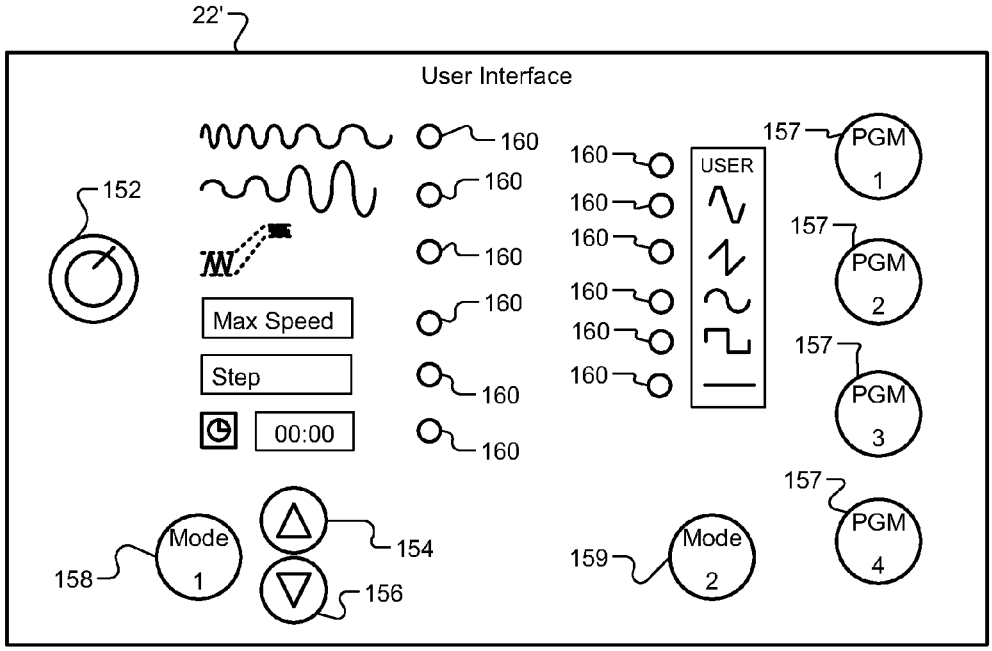
FIG. 4 is a front view of an exemplary user interface according to an embodiment of the present disclosure.
Figure 5:
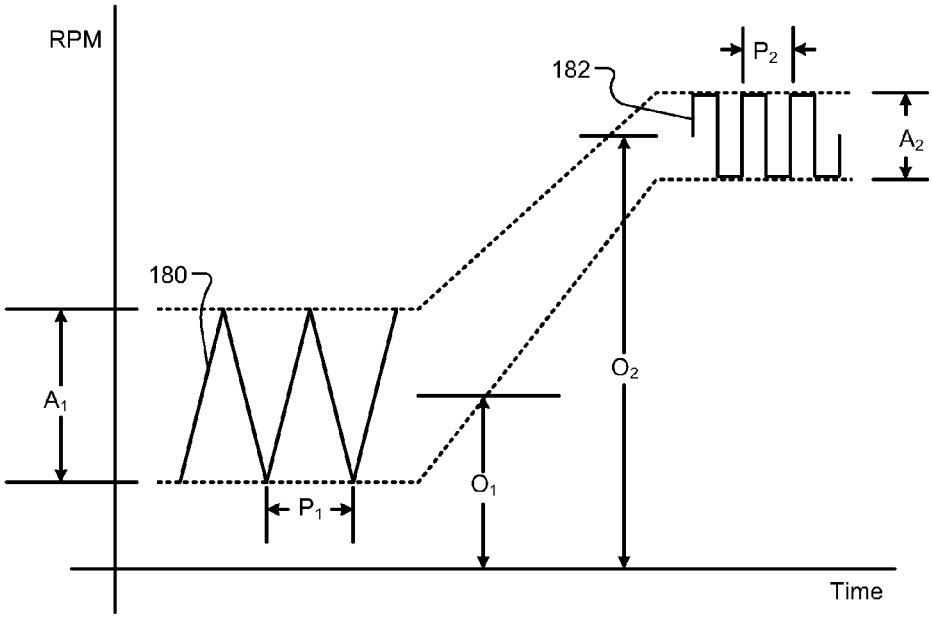
FIG. 5 is a motor speed diagram that illustrates exemplary changes in motor speed over time and according to an embodiment of the present disclosure.

For example only, the user interface 22 may include a remote keypad, such as that shown in FIG. 4. The external device 72 may include any portable electronic device or memory, such as, but not limited to, a personal computer, a memory stick, flash memory, a personal data assistant, a hard disk drive, a cellular phone, and/or a portable media player. The external device 72 may include or be connected to any network, such as, but not limited to, a communication network, such as a home network or a wireless local area network.

The power module 78 may include switching modules 90, filtering modules 92, and other modules 94, such as, but not limited to, signal conditioning modules. The switching modules 90 may include insulated-gate bipolar transistors (IGBTs) or other high-speed switching elements. The filtering and signal conditioning modules may include low-pass, high-pass, or bandpass filters and/or other conditioning elements to remove predetermined frequency components and to prevent radiating of signal lines. The switching modules 90 are used to generate pulse width modulated (PWM) signals and to synthesize complex waveforms.

The power module 78 generates waveforms that are provided to the electric motor 14. The waveforms may be based, for example, on 0-300V DC waveforms. The processing module 76 may signal the power module 78 to adjust a received or generated DC voltage. The DC voltage is altered to change the rate or acceleration at which the speed of the electric motor changes. The power module 78 effectively switches ON and OFF the DC voltage to generate a 3-phase AC signal. This does not switch ON and OFF the electric motor 14, but rather a supply voltage that is used to generate the 3-phase AC signal.

The 3-phase AC signal has a respective carrier frequency and may be referred to as a carrier signal. The main control module 80 controls the switching modules 90 to pulse width modulate the carrier signal. The PWM signal is provided to 3-phase inputs of the electric motor 14. The electric motor 14 performs as a low pass filter, and generates a low frequency waveform, such as a 3-600 Hz waveform.

For example, the switching modules 90 may be used to pulse width modulate a 3-phase AC signal that has a carrier frequency of 16 KHz. The switching modules 90 may pulse width modulate the 16 KHz signal to generate a motor drive output signal, which is provided to the electric motor 14. The frequencies of the carrier signal and the PWM signal may be adjusted via the user interface 22, the external device 72, and/or the processing module 76. The speed of the electric motor 14 oscillates based on the resulting 3-600 Hz signal generated within the electric motor 14. The 3-600 Hz signal may be referred to an internal electric motor drive signal, which is mechanically outputted to a pump, such as the pump 16 of FIG. 1.

By adjusting the pulse width modulation of the carrier signal, the resulting amplitude and/or frequency of the electric motor changes, resulting in a change in speed. The pulse width modulation may superimpose any waveform onto the carrier signal, such as, but not limited to a sine waveform, a square waveform, a triangle waveform, and a stepped waveform.

The electric motor 14 may provide a feedback signal and/or status signal to the motor drive 12. The status signal may include status of the current, voltage, or signal profiles provided to the electric motor 14, faults experienced by the electric motor 14, and status codes, among others. The motor drive 12 may alter subsequent signals provided to the electric motor 14 based on the status signals. In one embodiment, the motor drive 12 prevents power from being provided to the electric motor 14 based on reception of a fault signal from the electric motor. The status signals may be transmitted to the user interface 22 and/or to the external device 72 and indicated to a user.

The motor drive 12 may include a timer (not shown) that prevents the motor drive system 70 from reactivating the electric motor 14 after deactivation. For example, when a fault is resolved, the electric motor 14 may not be activated for a predetermined time period.

The motor drive 12 may also have stored predetermined parameter operating ranges with maximum and minimum values, such as for electric motor operating parameters. The operating ranges may be used to set limits for electric motor speed, amplitude, offset, frequency, period, etc.

Figure 3:
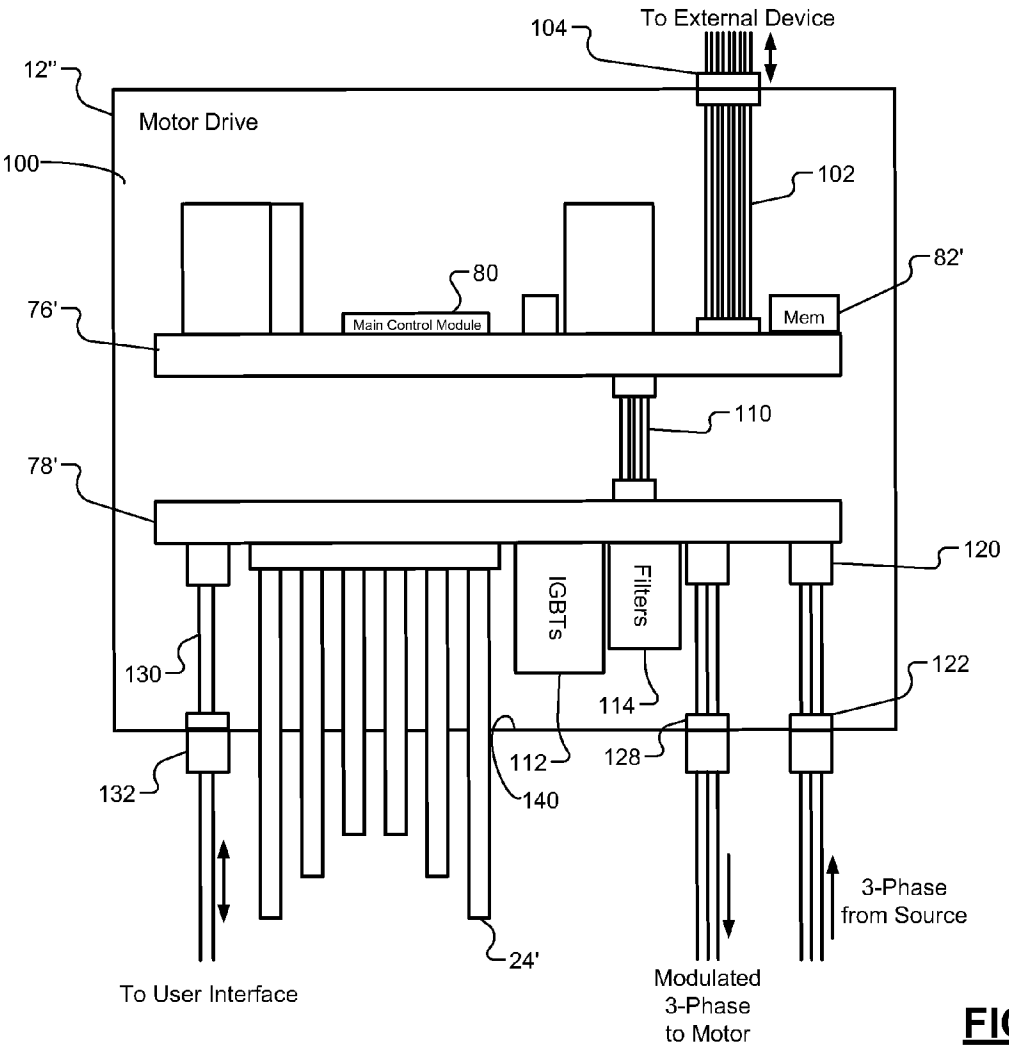
FIG. 3 is a functional block diagram of a motor drive according to an embodiment of the present disclosure.

Referring now to FIG. 3, a functional block diagram of an exemplary motor drive 12" is shown. The motor drive 12" includes an open ended housing 100 with a processing module 76' and a power module 78'. The processing module 76' and the power module 78' may be implemented on printed circuit boards (PCBs), as shown. The processing module 76' includes the main control module 80, memory 82', and a first communication link 102 to a first interface 104.

The first interface 104 may be a serial or parallel interface and be connected to an external device, such as the external device 72 of FIG. 2. The external interface 72 may be used for diagnostics and production line testing. The external interface 72 maybe used to directly control operation of the electric motor 14 and the pump 16. Electric motor speed, acceleration, and ON/OFF control may be provided via the first interface 104.

The power module 78' is in communication with the processing module 76' via a second communication link 110. The power module 78' includes IGBTs 112, filters 114, and a heat sink 24'. The power module 78' also includes a power input 120, which is connected to a power interface 122 that receives power from a power source. In one embodiment, power received from the power source is 3-phase AC power, as shown. The power module 78' may supply power to the processing module 76'.

The power module 78' outputs a power signal that has a selected profile to an electric motor via a motor output 128. The power module 78' may have a third communication link 130 that is connected to a second interface 132 for communication with a user interface.

The heat sink 24' is connected to the power module 78' and extends through an open end 140 of the housing 100. The heat sink 24' transfers thermal energy from the power module 78' and dissipates the thermal energy external to the housing 100.

Referring now to FIG. 4, a front view of an exemplary user interface 22 is shown. The user interface 22', for the example the embodiment shown, includes an ON/OFF button 152, increase and decrease buttons 154, 156 (i.e., a first selector), mode selection buttons 158, 159 (i.e., a second selector), and mode selected indicators 160.

The user interface 22' is provided as an example. The user interface 22' may include various other mode selection inputs and status indicators. The user interface 22' may include a graphical touch screen display, a keyboard, and/or other interface devices that allow for the selection and adjustment of electric motor signal profiles and thus fluid flow profiles. The display may indicate status of the electric motor and/or the status of other device of a variable fluid circulating system.

The ON/OFF button 152 may be used to activate and deactivate an electric motor, such as the electric motor 14. The electric motor may initially operate in a default mode when powered. The default mode may include operation based on a default signal profile. The default mode may include providing a constant current and/or voltage to the electric motor 14 to allow the electric motor to operate at an initial predetermined speed.

A first mode selection button 158 may be used to scroll, select and set any of a plurality of electric motor parameters, such as frequency, period, amplitude, and offset, of the current, voltage and/or speed of the electric motor.

Upon first selecting a motor parameter via the first mode selection button 158, the increase and decrease buttons 154, 156 may be used to establish or adjust the setting for that parameter. Consequently, the increase and decrease buttons 154, 156 may be used to adjust electric motor parameters, such as amplitude, frequency, period, and offset of the current, voltage and/or speed of the electric motor. For example, each time that the first mode selection button 158 is depressed a different motor parameter is selected and its corresponding mode selected indicator 160 is activated. Thereafter, the increase and decrease buttons 154, 156 may be depressed to adjust the setting of that motor parameter. If frequency is selected, the motor frequency may be increased or decreased; if amplitude is selected, the speed differential amplitude of the electric motor may be increased or decreased, and so forth.

Multiple electric motor parameters may be adjusted during operation of the electric motor. The variance in the electric motor parameters may be gradually, incrementally, and/or continuously increased or decreased by depression of the increase and decrease buttons 154, 156.

The second mode selection button 159 may be used, for the example embodiment shown, to select the shape of the signal profile generated by the electric motor. For example, the mode selector 159 may be depressed to scroll and select between a sine waveform, a triangular waveform, a sawtooth waveform, a ramp waveform, a square waveform, a constant waveform, a user-defined waveform, or between other waveforms, some of which are disclosed herein but not depicted in FIG. 4. The status indicators 160 may include light emitting diodes (LEDs) that illuminate to indicate the current selected waveform shape.

As would be readily understood by one skilled in the art, additional status indicators 160 indicating different user-selectable parameters accessible via either of the mode selection buttons 158, 159 may also be incorporated into the user interface, such as, but not limited to, different waveforms (e.g., stepped, square, etc.), motor speed, frequency, cycle time, amplitude, and offset.

The user interface 22' may also include one or more timers that may be set by a user. For example, a user may set the duration of time in which an electric motor of a variable fluid circulating system is operated based on a selected signal profile. Multiple signal profiles may be selected and corresponding operating lengths of time may be programmed for each signal profile. The elapsed time or time remaining may be displayed in a digital readout.

The user interface 22' may also include one or more selection buttons 157 (i.e., a third selector) enabling the user select from a variety of pre-programmed and/or user defined operation cycles for the electric motor.

The user interface 22' provides a simplified user control technique by allowing a user to alter multiple profile parameters at the same time by depressing a single button. For example, offset, amplitude (peak to peak speed), and frequency parameters of fluid feature waveforms may be adjusted by depressing the increase or decrease buttons.

Referring now to FIG. 5, a motor speed diagram that illustrates exemplary changes in motor speed over time is shown. The motor speed diagram is provided as an example; numerous other changes may be performed. The motor speed diagram includes a first signal profile 180 for a first mode of operation and a second signal profile 182 for a second mode of operation. The first and second signal profiles 180, 182 are internal electric motor drive signals that are outputted to a pump, such as the pump 16 of FIG. 1. The first signal profile 180 has a first speed differential amplitude $A_1$, a first period $P_1$, and a first offset $O_1$. The second signal profile 182 has a second speed differential amplitude $A_2$, a second period $P_2$, and a second offset $O_2$.

The signal profiles 180, 182 may be combined into a single signal profile. For each of the first and second profiles 180, 182 the electric motor is not cycled between ON and OFF states, but rather is cycled between different ON states, thereby providing continuous pump output.

A speed differential amplitude may refer to the difference in electric motor speed between upper and lower peaks of a profile signal. A period may refer to the time duration between upper peaks or lower peaks of a profile signal. Offset may refer to an average speed of a profile signal.

The first speed differential amplitude $A_1$ is greater than the second speed differential amplitude $A_2$. The first period $P_1$ is greater than the second period $P_2$. The first offset $O_1$ is less than the second offset $O_2$. The amplitudes, periods, and offsets may be periodically or continuously adjusted, either by the user, by the control logic of the processing module 76, or by both.

Figure 6:
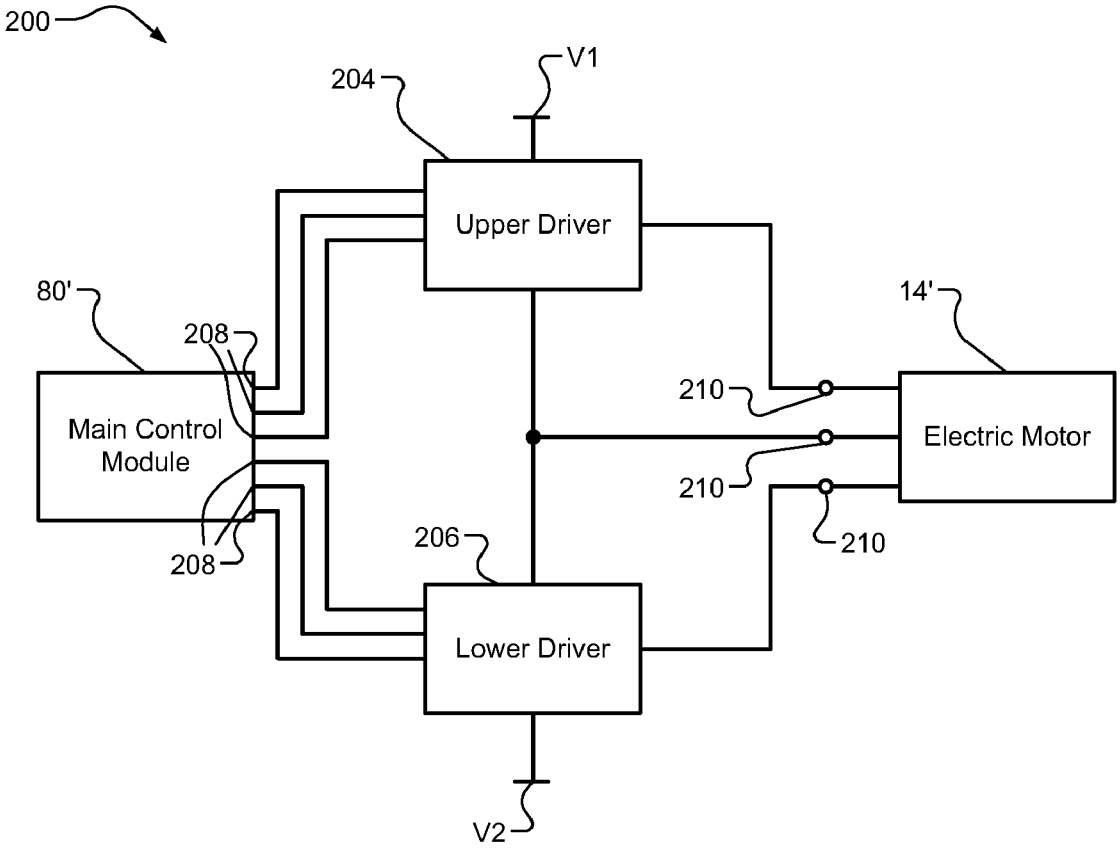
FIG. 6 is a functional block diagram of a motor drive circuit according to an embodiment of the present disclosure.

Referring now to FIG. 6, a motor drive circuit 200 is shown. The motor drive circuit 200 includes a main control module 80', upper and lower drivers 204, 206 and an electric motor 14'. The main control module 80' includes six outputs 208 that are respectively provided to the upper and lower drivers 204, 206. The upper and lower drivers 204, 206 may include IGBTs, or an equivalent. The upper driver 204 is coupled to a first voltage reference V1. The lower driver 206 is coupled to a second voltage reference V2. In one embodiment, the first voltage reference V1 is a supply voltage and the second reference voltage V2 is ground. The upper and lower drivers 204, 206 generate 3-phase signals, which are provided to an electric motor via 3-phase line terminals 210.

Figure 7:
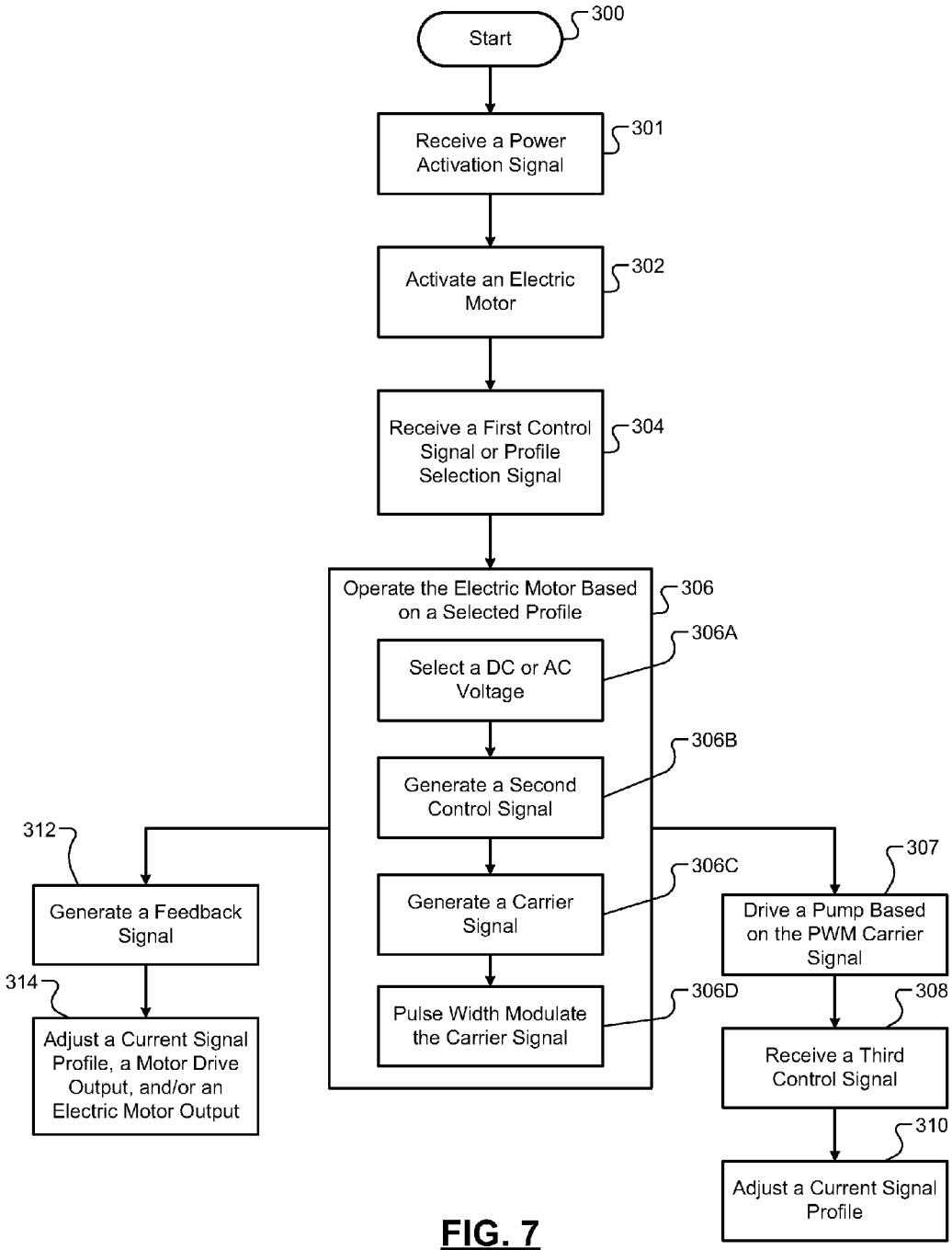
FIG. 7 is a flow diagram illustrating a method of operating a variable motor drive system according to an embodiment of the present disclosure.

Referring now to FIG. 7, a flow diagram illustrating a method of operating a variable motor drive system is shown. Although the following steps are primarily described with respect to the embodiments of FIGS. 1-5, the steps may be easily modified to apply to other embodiments of the present invention. The method may begin at step 300.

In step 301, a motor drive, such as the motor drive 12, receives a power activation signal from a user interface. In step 302, the motor drive activates an electric motor, such as the electric motor 14. The motor drive may operate the electric motor based on a default signal profile, a previous selected signal profile, or a predetermined profile. The motor drive may operate the electric motor at a nominal speed until a signal profile is selected.

In step 304, the motor drive receives a first control signal and/or a signal profile selection signal from a user interface or external device, such as from the user interface 22 or external device 72. The first control signal may refer to a stored signal profile. The signal profiles may each have corresponding signal parameters, such as amplitude, period, frequency, phase, offset, etc, that are constant or that vary over time. Selected signal profiles, which may be stored in memory, such as the memory 82, may include profiles of PWM signals for generation by a motor drive and/or profiles of motor drive signals for generation by an electric motor.

In step 306, a main control module of the motor drive operates the electric motor via a power module, such as the power module 78 based on the control signal and/or the signal profile selection signal. In step 306A, the main control module selects a DC or AC voltage based on the selected signal profile. The DC or AC voltage may be determined and generated based on a signal profile selected. The DC or AC voltage may be varied depending upon the selected signal profile. A DC voltage may be selected when generating a 3-phase AC signal based on switching of a DC signal ON and OFF, as described above.

In step 306B, the main control module generates a second control signal based on the selected DC voltage and the selected signal profile. The second control signal is provided to the power module to generate a carrier signal, which is generated in step 306C.

In step 306D, the main control module pulse width modulates the carrier signal via the power module based on the selected signal profile. The carrier signal may be modulated to match the selected signal profile. This effectively modulates the amplitude and/or frequency of an internal electric motor drive signal, which is outputted to a pump. The internal electric motor drive signal may be modulated to match the selected signal profile. The main control module may alter the rate at which the speed of the electric motor is changed multiple times when following a selected signal profile. This may be done by adjusting the amplitude of the DC voltage that is switched ON/OFF to generate a 3-phase AC signal or to generate a carrier signal that is provided to the electric motor.

In step 307, the internal electric motor drive signal is outputted to a pump to vary fluid flow to inlets of a reservoir. After completion of step 307, control may proceed to step 308. Optionally, or in addition to proceeding to step 308, the control may carry out step 312; that is, the control may carry out step 312 prior to carrying out step 308 or at the same time that step 308 is performed.

In step 308, the motor drive receives a third control signal. The third control signal may command an increase or decrease in one or more parameters of the internal electric motor drive signal and/or the amplitude of the DC voltage used to generate the 3-phase AC signal or the carrier signal. The third control signal may be, for example, generated based on the increase and decrease buttons on the user interface. The third control signal may alternatively indicate selection of a different signal profile.

In step 310, the motor drive adjusts the current signal profile based on the third control signal. The motor drive may alter the PWM signal that is currently being generated according to the third control signal or may retrieve another signal profile from memory. Adjustments to the current signal profile may be stored as a new signal profile in the memory.

In step 312, the electric motor or pump may generate a feedback signal, which is provided to the motor drive. In step 314, the motor drive may adjust a current signal profile, a motor drive output, and/or an electric motor output based on the feedback signal. When a fault is received or detected by the motor drive, the motor drive may deactivate the electric motor or operate the electric motor at a nominal speed based on the feedback signal.

The above-described steps are meant to be illustrative examples; the steps may be performed sequentially, synchronously, simultaneously, continuously, during overlapping time periods or in a different order depending upon the application. For example, steps 312-314 may be performed before during or after any of steps 301-310.

The variable speed drive of the above described embodiments allows for various options for fluid flow and control of fluid features. Numerous fluid flow profiles or features may be programmed into the motor drives described herein.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A motor drive for an electric motor of a variable fluid circulating system comprising:

a user interface configured to enable selection of a signal profile from a plurality of signal profiles;

a processing module that receives a signal profile selected with the user interface and generates a control signal based on the selected signal profile; and a power module that modulates a carrier signal of a power signal based on the control signal and a direct current (DC) voltage to generate a first motor drive output signal in the electric motor that matches a first selected signal profile during a first time period and to generate a second motor drive output signal during a second time period to match another signal profile selected with the user interface; and a pump connected to an output shaft of the electric motor, the pump being driven by the electric motor with reference to the first motor drive output signal during the first time period and with reference to the second motor drive output signal during the second time period to adjust injection of a fluid by the pump into a reservoir.

2. The motor drive of claim 1, wherein the power module adjusts an amplitude of at least one of the carrier signal, the first motor drive output signal, and the second motor drive output signal based on the control signal.

3. The motor drive of claim 1, wherein the power module adjusts an offset of at least one of the carrier signal, the first motor drive output signal, and the second motor drive output signal based on the control signal.

4. The motor drive of claim 1, wherein the power module adjusts a frequency of at least one of the carrier signal, the first motor drive output signal, and the second motor drive output signal based on the control signal.

5. The motor drive of claim 1, wherein the power module adjusts phase modulation of at least one of the carrier signal, the first motor drive output signal, and the second motor drive output signal based on the control signal.

6. The motor drive of claim 1, wherein the power module adjusts a period of at least one of the carrier signal, the first motor drive output signal, and the second motor drive output signal based on the control signal.

7. The motor drive of claim 1 wherein the first motor drive output signal has a first amplitude and the second motor drive output signal has a second amplitude, and wherein the first amplitude is different than the second amplitude.

8. The motor drive of claim 1 wherein the first motor drive output signal has a first offset and the second motor drive output signal has a second offset, and wherein the first offset is different than the second offset.

9. The motor drive of claim 1 wherein the first motor drive output signal has a first frequency and the second motor drive output signal has a second frequency, and wherein the first frequency is different than the second frequency.

10. The motor drive of claim 1 wherein the first motor drive output signal has a first period and the second motor drive output signal has a second period, and wherein the first period is different than the second period.

11. The motor drive of claim 1, wherein said power module superimposes a waveform onto the carrier signal of the power signal when pulse width modulating the carrier signal to generate the first motor drive output signal and the second motor drive output signal.

12. The motor drive of claim 11, wherein the waveform is one of a sine, waveform, a square waveform, a triangle waveform, and a stepped waveform.

13. The motor drive of claim 1, wherein the power module cycles the electric motor between ON and OFF states to generate the first motor drive output signal and the second motor drive output signal.

14. The motor drive of claim 1, wherein the power module cycles the electric motor between M ON states to generate the first motor drive output signal and the second motor drive output signal, where M is an integer greater than 1.

15. The motor drive of claim 1, wherein the power signal is a 3-phase alternating current (AC) signal.

16. The motor drive of claim 1, wherein the power module limits speed, amplitude, offset, frequency and period of the electric motor.

17. The motor drive of claim 1, wherein the power module generates and pulse width modulates the carrier signal of the power signal to vary pressure, flow volume and flow rate of the fluid injected into the reservoir based on the first motor drive output signal and the second motor drive output signal.

18. A variable fluid circulating system for at least one of a spa, a tub, and a pool comprising:

a user interface that generates a first control signal;

a motor drive comprising:

a processing module that comprises a microprocessor that generates a second control signal based on the first control signal; and a power module that pulse width modulates a carrier signal of a three phase AC signal with reference to the second control signal and a direct current (DC) voltage to generate a motor drive output signal with a first signal profile;

an electric motor that is powered by the motor drive output signal and that generates the internal electric motor drive signal based on the motor drive output signal; and a pump that receives the internal electric motor drive signal via a mechanical coupling that is connected to the electric motor.

19. The variable fluid circulating system of claim 18 further comprising:

memory that stores N signal profiles, where N is an integer, and the processing module is configured to select one of the N signal profiles based on the first control signal and generates a second control signal based the selected one profile in the N signal profiles.

20. The variable fluid circulating system of claim 19, wherein the power module pulse width modulates the carrier signal to generate another motor drive output signal that matches the selected one profile in the N signal profiles.

21. The variable fluid circulating system of claim 20, wherein the power module generates the motor drive output signal during a first time period, and wherein the power drive module generates the other motor drive output signal during a second time period.

22. The variable fluid circulating system of claim 21, wherein the motor drive output signal has a first amplitude, a first offset, a first frequency, and a first period, wherein the other motor drive output signal has a second amplitude, a second offset, a second frequency, and a second period, and wherein the first amplitude is different than the second amplitude, the first offset is different than the second offset, the first frequency is different than the second frequency, and the first period is different than the second period.

23. The variable fluid circulating system of claim 18, wherein the power module pulse width modulates an amplitude and a frequency of the carrier signal to generate the motor drive output signal.

24. The variable fluid circulating system of claim 23, wherein speed of the electric motor varies based on the amplitude modulation and the frequency modulation of the motor drive output signal.

25. The variable fluid circulating system of claim 24, wherein the power module adjusts variance in the DC voltage based on the first control signal, and wherein rate of change in the speed varies based on the variance in the DC voltage.

26. The variable fluid circulating system of claim 18, wherein the pump injects and varies a flow of a fluid into a reservoir of one of the spa, the tub and the pool based on the motor drive output signal.

27. The variable fluid circulating system of claim 18, wherein the pump injects and varies pressure, flow volume and flow rate of a fluid injected into a reservoir of one of the spa, the tub and the pool based on the motor drive output signal.

28. The variable fluid circulating system of claim 18, wherein the user interface comprises a selector, and wherein the power module adjusts amplitude, offset and frequency of the motor drive output signal based on a state of the selector.

29. The variable fluid circulating system of claim 28, wherein the processing module selects one of N signal profiles based on a change in the state of the selector, where N is an integer greater than 1, and wherein the N signal profiles have N distinct amplitudes, N distinct offsets and N distinct frequencies.

* * * * *